US009688506B2

(12) United States Patent
Inubushi et al.

(10) Patent No.: US 9,688,506 B2
(45) Date of Patent: Jun. 27, 2017

(54) COIL COMPONENT

(71) Applicant: MURATA MANUFACTURING CO., LTD., Kyoto (JP)

(72) Inventors: Toshikazu Inubushi, Nagaokakyo (JP); Kousuke Tachibana, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 439 days.

(21) Appl. No.: 14/456,400

(22) Filed: Aug. 11, 2014

(65) Prior Publication Data

US 2015/0090834 A1 Apr. 2, 2015

(30) Foreign Application Priority Data

Sep. 27, 2013 (JP) ..... 2013-201107

(51) Int. Cl.

| | |
|---|---|
| ***H01F 5/02*** | (2006.01) |
| ***B65H 75/26*** | (2006.01) |
| ***H01F 5/00*** | (2006.01) |
| ***H01F 41/066*** | (2016.01) |
| *H01F 27/29* | (2006.01) |

(52) U.S. Cl.

CPC ..... *B65H 75/26* (2013.01); *H01F 5/00* (2013.01); *H01F 41/066* (2016.01); *H01F 5/02* (2013.01); *H01F 27/292* (2013.01)

(58) Field of Classification Search

CPC ..... B65H 54/02; B65H 55/005; B65H 75/26; H01F 41/04; H01F 41/066; H01F 41/069; H01F 41/073; H01F 41/086

USPC ..... 242/444.2, 444.3, 444.4

See application file for complete search history.

(56) References Cited

U.S. PATENT DOCUMENTS

| | | | | |
|---|---|---|---|---|
| 5,767,450 | A * | 6/1998 | Furuhata | H01B 3/308 174/110 R |
| 7,118,063 | B2 * | 10/2006 | Hanusiak | B22F 3/002 242/443 |
| 2003/0043009 | A1 * | 3/2003 | Chow | H01F 30/04 336/195 |

(Continued)

FOREIGN PATENT DOCUMENTS

| | | | |
|---|---|---|---|
| CN | 103165261 | A | 6/2013 |
| JP | H04-329606 | A | 11/1992 |

(Continued)

OTHER PUBLICATIONS

An Office Action; "Notification of Reasons for Refusal," issued by the Japanese Patent Office on Jun. 7, 2016, which corresponds to Japanese Patent Application No. 2013-201107 and is related to U.S. Appl. No. 14/456,400; with English language translation.

(Continued)

*Primary Examiner* — Emmanuel M Marcelo

(74) *Attorney, Agent, or Firm* — Studebaker & Brackett PC

(57) ABSTRACT

A coil component has a core including a winding core extending in a predetermined direction, and a winding wrapped around the winding core in two or more layers. A first winding portion at one end in the predetermined direction in an (n+1)'th layer of the winding, where n is a natural number, is positioned over a space between second and third winding portions in an n'th layer, the second and third winding portions being adjacently spaced in the predetermined direction.

6 Claims, 3 Drawing Sheets

(56) References Cited

U.S. PATENT DOCUMENTS

| | | | | |
|---|---|---|---|---|
| 2004/0183639 | A1* | 9/2004 | Okura | H01F 27/2823 336/180 |
| 2012/0319614 | A1* | 12/2012 | Lee | H01F 27/325 315/254 |
| 2012/0320505 | A1* | 12/2012 | Lee | H01F 27/346 361/679.01 |
| 2013/0154788 | A1* | 6/2013 | Morimoto | H01F 5/00 336/221 |
| 2013/0169400 | A1* | 7/2013 | Kim | H01F 27/2823 336/192 |
| 2014/0153209 | A1* | 6/2014 | Nam | H01F 5/02 361/782 |

FOREIGN PATENT DOCUMENTS

| | | | |
|---|---|---|---|
| JP | H10-41151 | A | 2/1998 |
| JP | 2001-267151 | A | 9/2001 |
| JP | 2011-253922 | A | 12/2011 |
| JP | 2012-009710 | A | 1/2012 |
| JP | 2013-128003 | A | 6/2013 |

OTHER PUBLICATIONS

An Office Action; "Notification of Reasons for Rejection," issued by the Japanese Patent Office on Oct. 6, 2015, which corresponds to Japanese Patent Application No. 2013-201107 and is related to U.S. Appl. No. 14/456,400; with English language translation.

* cited by examiner

COIL COMPONENT

CROSS REFERENCE TO RELATED APPLICATIONS

This application claims benefit of priority to Japanese Patent Application No. 2013-201107 filed on Sep. 27, 2013, the entire content of which is incorporated herein by reference.

TECHNICAL FIELD

The present technical field relates to coil components, more particularly to a coil component including a core and a winding wrapped around the core.

BACKGROUND

As a disclosure relevant to a conventional coil component, a wound coil described in, for example, Japanese Patent Laid-Open Publication No. 4-329606 is known. FIG. 3 is a cross-sectional structure view of the wound coil described in Japanese Patent Laid-Open Publication No. 4-329606.

The wound coil described in Japanese Patent Laid-Open Publication No. 4-329606 has a winding 106 wrapped in three layers around a core portion 103, as shown in FIG. 3. In such a wound coil, a winding portion 106*a* at the end of the second layer and a winding portion 106*b* at the end of the third layer might slip out of place onto the core portion 103.

SUMMARY

A coil component according to a preferred embodiment of the present disclosure comprises a core including a winding core extending in a predetermined direction, and a winding wrapped around the winding core in two or more layers. A first winding portion at one end in the predetermined direction in an (n+1)'th layer of the winding, where n is a natural number, is positioned over a space between second and third winding portions in an n'th layer, the second and third winding portions being adjacently spaced in the predetermined direction.

The above and other elements, features, steps, characteristics and advantages of the present disclosure will become more apparent from the following detailed description of the preferred embodiments with reference to the attached drawings.

DETAILED DESCRIPTION OF THE PREFERRED EMBODIMENTS

Figure 1:
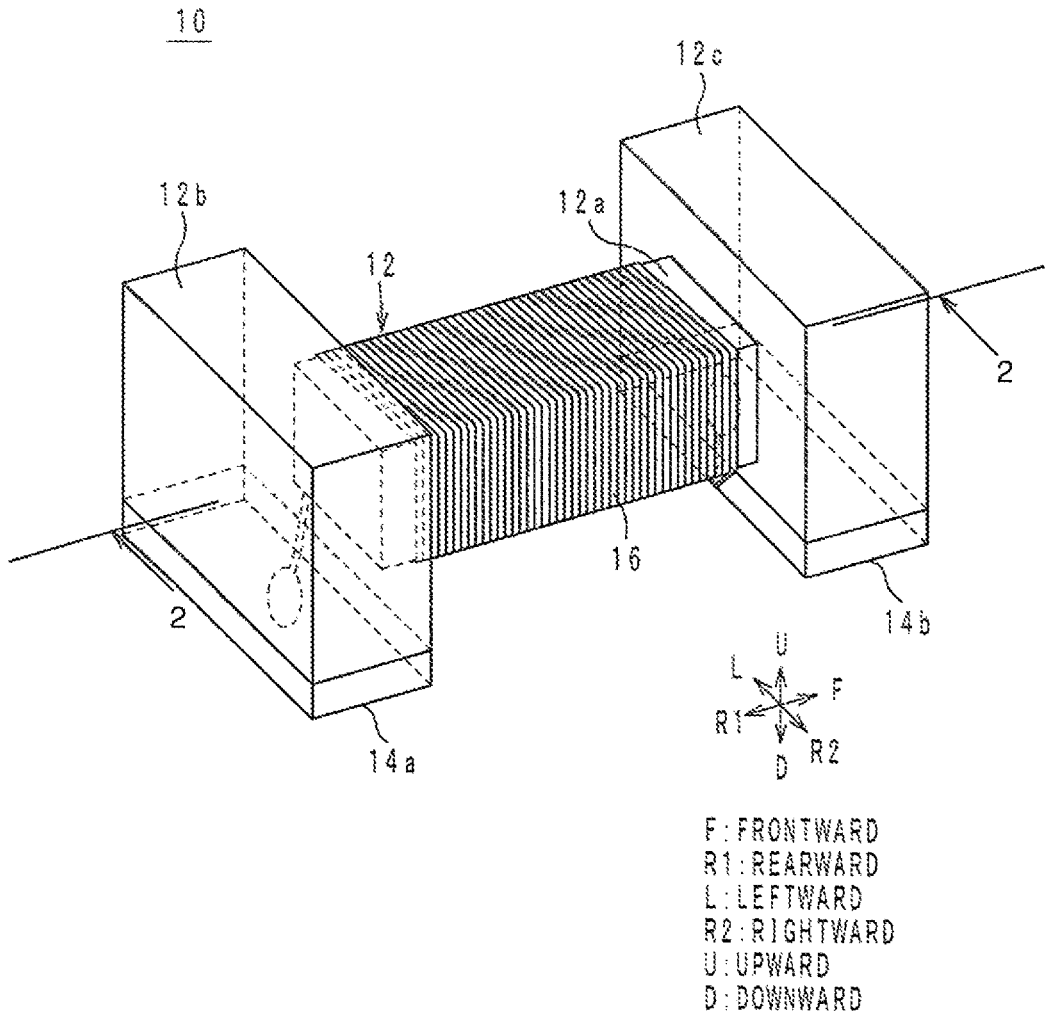
FIG. 1 is an external oblique view of a coil component 10.
Figure 2:
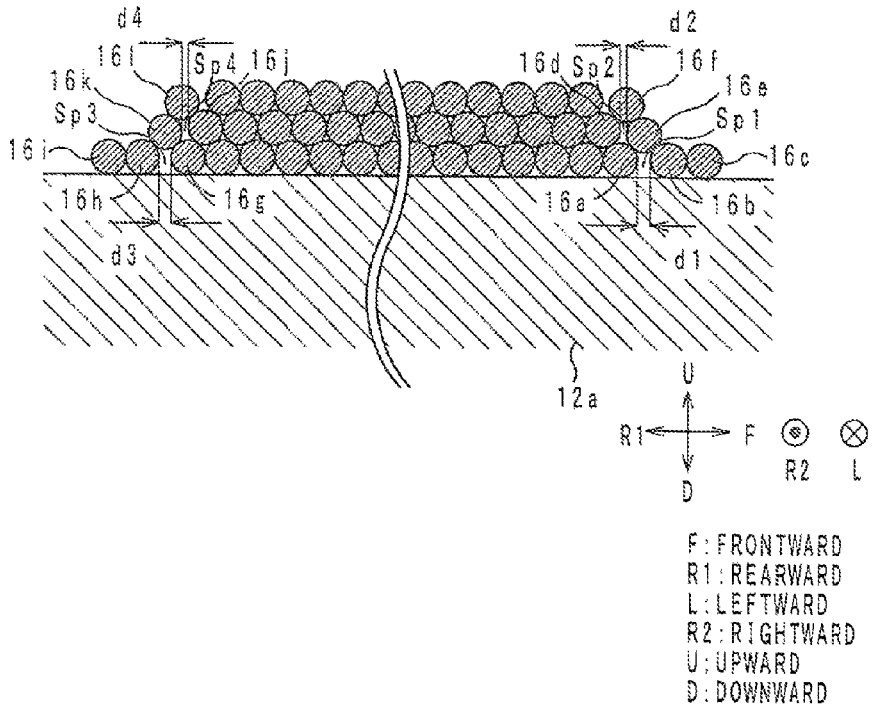
FIG. 2 is a cross-sectional structure view of the coil component 10 taken along line 2-2 of FIG. 1.
Figure 3:
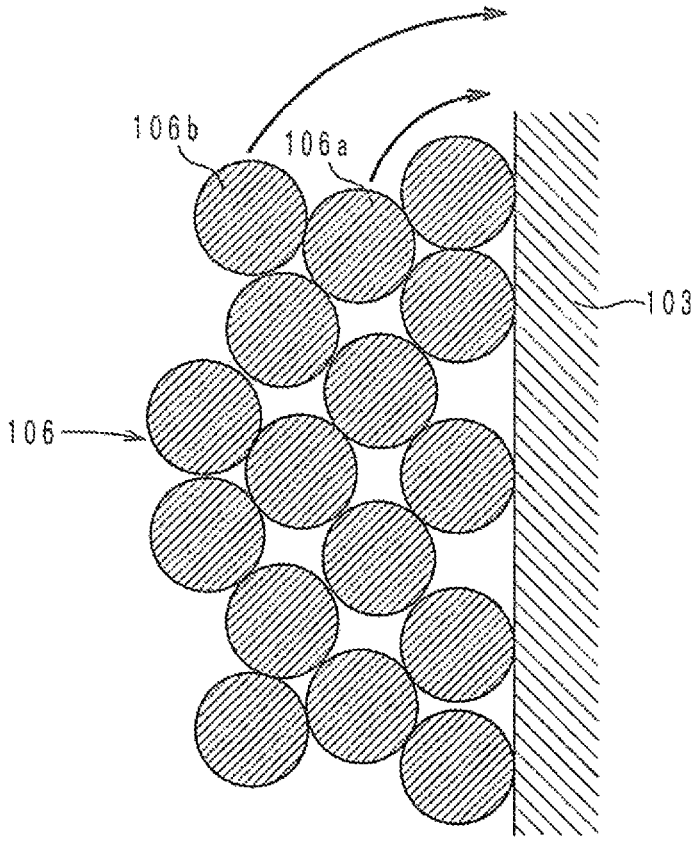
FIG. 3 PRIOR ART
FIG. 3 is a cross-sectional structure view of a wound coil described in Japanese Patent Laid-Open Publication No. 4-329606.

Hereinafter, a coil component 10 according to an embodiment of the present disclosure will be described with reference to the drawings. FIG. 1 is an external oblique view of the coil component 10. FIG. 2 is a cross-sectional structure view of the coil component 10 taken along line 2-2 of FIG. 1. In the following, the top-bottom direction of FIG. 1 will be simply defined as the top-bottom direction. The direction in which a winding core 12*a* extends will be defined as the front-back direction. Further, the direction perpendicular to both the top-bottom direction and the front-back direction will be defined as the right-left direction.

The coil component 10 includes a core 12, a winding 16, and external electrodes 14*a* and 14*b*, as shown in FIG. 1.

The core 12 is made from a magnetic material such as ferrite or alumina, and includes the winding core 12*a* and flanges 12*b* and 12*c*.

The winding core 12*a* is a prism-like member extending in the front-back direction. However, the winding core 12*a* is not limited to a prism-like shape, and may be cylindrical or polygonal.

The flange 12*b* is in the form of a rectangular solid provided at the rear end of the winding core 12*a* and being thin in the front-back direction, as shown in FIG. 1. The flange 12*b*, when viewed in a front view, protrudes from the winding core 12*a* both in the top-bottom direction and the right-left direction.

The flange 12*c* is in the form of a rectangular solid provided at the fore end of the winding core 12*a* and being thin in the front-back direction, as shown in FIG. 1. The flange 12*c*, when viewed in a front view, protrudes from the winding core 12*a* both in the top-bottom direction and the right-left direction.

The external electrode 14*a* is provided on the bottom surface of the flange 12*b*, so as to be flush with the four surfaces of the flange 12*b* that are adjacent to the bottom surface. The external electrode 14*b* is provided on the bottom surface of the flange 12*c*, so as to be flush with the four surfaces of the flange 12*c* that are adjacent to the bottom surface. The external electrodes 14*a* and 14*b* are provided, for example, by performing Ni-plating and Sn-plating on base electrodes formed by coating the flanges 12*b* and 12*c* with a conductive paste mainly composed of Ag.

The winding 16 is a conductor wound around the winding core 12*a*, as shown in FIG. 1, and includes a core wire mainly composed of a conductive material such as copper or silver and coated with an insulating material such as polyurethane. The winding 16 is wrapped in three layers on the winding core 12*a*, as shown in FIG. 2. More specifically, the first layer of the winding 16, when viewed in a front view, is wrapped counterclockwise in the direction from the rear end of the winding core 12*a* toward the fore end. The first layer of the winding 16 is a portion of the winding 16 that is wrapped directly on the winding core 12*a*. The second layer of the winding 16, when viewed in a front view, is wrapped counterclockwise in the direction from the fore end of the winding core 12*a* toward the rear end. The second layer of the winding 16 is a portion of the winding 16 that is wrapped on the first layer of the winding 16. The third layer of the winding 16, when viewed in a front view, is wrapped counterclockwise in the direction from the rear end of the winding core 12*a* toward the fore end. The third layer of the winding 16 is a portion of the winding 16 that is wrapped on the second layer of the winding 16. Further, the winding 16 is connected at opposite ends to the external electrodes 14*a* and 14*b* by thermocompression bonding.

Here, in the case where the winding 16 is wrapped in three layers, the winding 16 at opposite ends in the front-back direction in the second and third layers might slip out of place onto the winding core 12*a*. Therefore, in the coil component 10, a winding portion 16*e* at the fore end of the second layer is positioned over a space Sp1 between winding portions 16*a* and 16*b* in the first layer, which are adjacently spaced in the front-back direction. More specifically, in the first layer of the winding 16, the winding portions 16*a* and 16*b* are respectively second and third from front and placed apart from each other in the front-back direction, and the space Sp1 is positioned therebetween. In the second layer of the winding 16, the winding portion 16*e* at the fore end is supported by the winding portions 16*a* and 16*b* over the space Sp1.

Furthermore, a winding portion 16*f* at the fore end of the third layer is positioned over a space Sp2 between a winding portion 16*d* and the winding portion 16*e* in the second layer, which is adjacently spaced in the front-back direction. More specifically, in the second layer of the winding 16, the winding portions 16*d* and 16*e* are respectively second and first from front and placed apart from each other in the front-back direction, and the space Sp2 is positioned therebetween. In the third layer of the winding 16, the winding portion 16*f* at the fore end is supported by the winding portions 16*d* and 16*e* over the space Sp2.

Furthermore, the winding 16 is layered near the rear end of the winding core 12*a* in the same manner as it is layered near the fore end of the winding core 12*a*. Specifically, a winding portion 16*k* at the rear end of the second layer is positioned over a space Sp3 between winding portions 16*g* and 16*h* in the first layer, which are adjacently spaced in the front-back direction. More specifically, in the first layer of the winding 16, the winding portions 16*g* and 16*h* are respectively third and second from back and placed apart from each other in the front-back direction, and the space Sp3 is positioned therebetween. In the second layer of the winding 16, the winding portion 16*k* at the rear end is supported by the winding portions 16*g* and 16*h* over the space Sp3.

Furthermore, a winding portion 16*l* at the rear end of the third layer is positioned over a space Sp4 between a winding portion 16*j* and the winding portion 16*k* in the second layer, which is adjacently spaced in the front-back direction. More specifically, in the second layer of the winding 16, the winding portions 16*j* and 16*k* are respectively second and first from back and placed apart from each other in the front-back direction, and the space Sp4 is positioned therebetween. In the third layer of the winding 16, the winding portion 16*l* at the rear end is supported by the winding portions 16*j* and 16*k* over the space Sp4.

Here, the widths of the spaces Sp1 to Sp4 in the front-back direction (simply referred to below as the widths of the spaces Sp1 to Sp4) will be described. In the coil component 10, the winding 16 is wrapped densely around the winding core 12*a* so as not to leave much space, as shown in FIG. 2. On the other hand, the spaces Sp1 to Sp4 are provided on purpose, respectively, between the winding portions 16*a* and 16*b*, between the winding portions 16*d* and 16*e*, between the winding portions 16*g* and 16*h*, and between the winding portions 16*j* and 16*k*. The width of the spaces Sp1 and Sp3 is larger than any space in the first layer of the winding 16 other than the space between the winding portions 16*a* and 16*b* and the space between the winding portions 16*g* and 16*h*. Further, the width of the spaces Sp2 and Sp4 is larger than any space in the second layer of the winding 16 other than the space between the winding portions 16*d* and 16*e* and the space between the winding portions 16*j* and 16*k*.

In this manner, the winding portion 16*e* is positioned above the space Sp1 and supported by the winding portions 16*a* and 16*b*, whereby the winding portion 16*e* is inhibited from slipping out of place onto the winding core 12*a* beyond the winding portion 16*b* and a winding portion 16*c*. More specifically, the overlap of the winding portion 16*e* with the winding portions 16*a* and 16*b* in the top-bottom direction is larger when the space Sp1 is provided than when the space Sp1 is not provided. Therefore, to slip out of place beyond the winding portions 16*b* and 16*c*, the winding portion 16*e* is required to move significantly upward when the space Sp1 is provided more than when the space Sp1 is not provided. Thus, in the coil component 10, the winding portion 16*e* is inhibited from slipping out of place onto the winding core 12*a* beyond the winding portions 16*b* and 16*c*. Further, for similar reasons, the winding portion 16*f* is inhibited from slipping out of place onto the winding core 12*a* beyond the winding portion 16*e*, the winding portion 16*k* is inhibited from slipping out of place onto the winding core 12*a* beyond the winding portion 16*h* and a winding portion 16*i*, and the winding portion 16*l* is inhibited from slipping out of place onto the winding core 12*a* beyond the winding portion 16*k*.

Furthermore, as the width of the space Sp1 increases, the overlap of the winding portion 16*e* with the winding portions 16*a* and 16*b* in the top-bottom direction increases, so that the winding portion 16*e* is reliably inhibited from slipping out of place onto the winding core 12*a* beyond the winding portions 16*b* and 16*c*. Similarly, as the width of the space Sp2 increases, the overlap of the winding portion 16*f* with the winding portions 16*d* and 16*e* in the top-bottom direction increases, so that the winding portion 16*f* is reliably inhibited from slipping out of place onto the winding core 12*a* beyond the winding portion 16*e*. Moreover, as the width of the space Sp3 increases, the overlap of the winding portion 16*k* with the winding portions 16*g* and 16*h* in the top-bottom direction increases, so that the winding portion 16*k* is reliably inhibited from slipping out of place onto the winding core 12*a* beyond the winding portions 16*h* and 16*i*. Furthermore, as the width of the space Sp4 increases, the overlap of the winding portion 16*l* with the winding portions 16*j* and 16*k* in the top-bottom direction increases, so that the winding portion 16*l* is reliably inhibited from slipping out of place onto the winding core 12*a* beyond the winding portion 16*k*.

However, if the spaces Sp1 to Sp4 are excessively wide, the winding portions 16*e*, 16*f*, 16*k*, and 16*l* fall into the spaces Sp1 to Sp4 (such a fall will be referred to below as "layer-down" or will be described below as "falling a layer down"). Therefore, the spaces Sp1 to Sp4 are preferably smaller than the diameter of the winding 16. Further, to prevent such layer-down more effectively, the widths of the spaces Sp1 to Sp4 are preferably less than or equal to the diameter of the winding 16. To prove that it is preferable for the widths of the spaces Sp1 to Sp4 to be less than or equal to the diameter of the winding 16, the present inventors conducted experimentation as described below.

The present inventors produced coil components 10 in which a winding 16 having a diameter of 15 μm was wrapped around a winding core 12*a* with 15 turns in each of the first and second layers. That is, the produced coil components 10 did not have the third layer of the winding 16 shown in FIG. 2. The spaces Sp1 of the produced coil components 10 had different widths of 5 μm, 10 μm, 15 μm, 20 μm, 25 μm, 30 μm, 40 μm, and 50 μm. In the following, a sample with the space Sp1 having a width of 5 μm will be referred to as a "first sample". A sample with the space Sp1 having a width of 10 μm will be referred to as a "second sample". A sample with the space Sp1 having a width of 15 μm will be referred to as a "third sample". A sample with the space Sp1 having a width of 20 μm will be referred to as a "fourth sample". A sample with the space Sp1 having a width of 25 μm will be referred to as a "fifth sample". A sample with the space Sp1 having a width of 30 μm will be referred to as a "sixth sample". A sample with the space Sp1 having a width of 40 μm will be referred to as a "seventh sample". A sample with the space Sp1 having a width of 50 μm will be referred to as an "eighth sample". For each of the first through eighth samples, the value of (the width of the space Sp1)/(the diameter of the winding) is as listed below.

First Sample: 0.17
Second Sample: 0.33
Third Sample: 0.50
Fourth Sample: 0.67
Fifth Sample: 0.83
Sixth Sample: 1.00
Seventh Sample: 1.33
Eighth Sample: 1.67

The present inventors produced 100 of each of the first through eighth samples, and studied the percentage of the occurrence of layer-down for each sample. The experimentation results are as listed below.

First Sample: 0%
Second Sample: 0%
Third Sample: 0%
Fourth Sample: 33%
Fifth Sample: 72%
Sixth Sample: 100%
Seventh Sample: 100%
Eighth Sample: 100%

From the experimentation results, it can be appreciated that the occurrence of layer-down was reduced for each of the first through fifth samples for which the value of (the width of the space Sp1)/(the diameter of the winding) was less than 1.00. Further, it can also be appreciated that no layer-down occurred in each of the first through third samples for which the value of (the width of the space Sp1)/(the diameter of the winding) was less than or equal to 0.50. Therefore, to prevent layer-down more effectively, the widths of the spaces Sp1 to Sp4 are preferably less than or equal to a half of the diameter of the winding 16.

In the first layer, the winding portion 16*c* is positioned ahead of the winding portions 16*a* and 16*b*. Therefore, the winding portion 16*b* is restrained from moving forward. Thus, it is possible to inhibit the winding portion 16*e* from falling a layer down.

Furthermore, in the first layer, the winding portion 16*i* is positioned behind the winding portions 16*g* and 16*h*. Therefore, the winding portion 16*h* is restrained from moving backward. Thus, it is possible to inhibit the winding portion 16*k* from falling a layer down.

Note that the coil component 10 may have only either one of the spaces Sp1 and Sp3. In the case where the space Sp1 is provided, the space Sp1 may be wider than any space in the first layer of the winding 16 other than the space between the winding portions 16*a* and 16*b*. In the case where the space Sp3 is provided, the space Sp3 may be wider than any space between winding portions in the first layer other than the space between the winding portions 16*g* and 16*h*. Also, the coil component 10 may have only either one of the spaces Sp2 and Sp4.

Furthermore, in the coil component 10, the winding 16 is wrapped around the winding core 12*a* in two or more layers. However, in the case where the coil component 10 is of a horizontally wound type to be mounted on a circuit board with the winding core 12*a* positioned so as to be parallel to the horizontal direction, the number of layers is preferably odd. The reason for this is that in such a horizontally wound coil component 10, the external electrodes 14*a* and 14*b* are provided on the flanges 12*b* and 12*c*, respectively, and therefore, both ends of the winding 16 need to be led out at opposite ends of the winding core 12*a*.

On the other hand, in the case where the coil component 10 is of a vertically wound type to be mounted on a circuit board with the winding core 12*a* positioned so as to be parallel to the vertical direction, the number of layers is preferably even. The reason for this is that in such a vertically wound coil component 10, the external electrodes 14*a* and 14*b* are provided on either one of the flanges 12*b* and 12*c*, and therefore, both ends of the winding 16 need to be led out at one end of the winding core 12*a*.

Furthermore, in the coil component 10, a winding portion 16 at the fore end in the (n+1)'th layer, where n is a natural number, is positioned over a space between two winding portions in the n'th layer, which are adjacently spaced in the front-back direction. The coil component 10 is not limited by the cases where n=1 or n=2. That is, the positional relationship between winding portions in the first and second layers or between winding portions in the second and third layers is not limiting.

While preferred embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. A coil component, comprising:

a core including a winding core extending in a predetermined direction; and a winding wrapped around the winding core in two or more layers, wherein, a first winding portion at one end in the predetermined direction in an (n+1)'th layer of the winding, where n is a natural number, is positioned over a space between second and third winding portions in an n'th layer, the second and third winding portions being adjacently spaced in the predetermined direction, and the space between the second and third winding portions has a width in the predetermined direction less than a diameter of the winding but greater than a width in the predetermined direction of any space between winding portions in the n'th layer other than the space between the second and third winding portions.

2. The coil component according to claim 1, wherein the width in the predetermined direction of the space between the second and third winding portions is less than or equal to a half of the diameter of the winding.

3. The coil component according to claim 1, wherein a fourth winding portion is provided in the n'th layer so as to be positioned on one side in the predetermined direction relative to the second and third winding portions.

4. A coil component, comprising:

a core including a winding core extending in a predetermined direction; and a winding wrapped around the winding core in two or more layers, wherein, a first winding portion at one end in the predetermined direction in an (n+1)'th layer of the winding, where n is a natural number, is positioned over a space between second and third winding portions in an n'th layer, the second and third winding portions being adjacently spaced in the predetermined direction, a fifth winding portion is provided at the other end in the predetermined direction in the (n+1)'th layer, so as to be positioned over a space between sixth and seventh winding portions in the n'th layer, the sixth and seventh winding portions being adjacently spaced in the predetermined direction, and the space between the sixth and seventh winding portions and the space between the second and third winding portions have widths in the predetermined direction less than a diameter of the winding but greater than any space between winding portions in the n'th layer other than the space between the second and third winding portions and the space between the sixth and seventh winding portions.

5. The coil component according to claim 4, wherein the width in the predetermined direction of the space between the second and third winding portions is less than or equal to a half of the diameter of the winding.

6. The coil component according to claim 4, wherein a fourth winding portion is provided in the n'th layer so as to be positioned on one side in the predetermined direction relative to the second and third winding portions.

* * * * *